US006568060B1

(12) United States Patent
Lawrence et al.

(10) Patent No.: US 6,568,060 B1
(45) Date of Patent: May 27, 2003

(54) METHOD AND FIXTURE FOR FILLED BILLET PACKING

(75) Inventors: Robert Daniel Lawrence, Butler, OH (US); Dewayne Renaldo Davis, Avondale, OH (US); Edward Harvey Goldman, Cincinnati, OH (US); Steven Randolph Norris, Cincinnati, OH (US); William Charles Mosier, West Chester, OH (US)

(73) Assignee: Polymet Corporation, Cincinnati, OH (US)

( * ) Notice: Subject to any disclaimer, the term of this patent is extended or adjusted under 35 U.S.C. 154(b) by 0 days.

(21) Appl. No.: 09/586,870

(22) Filed: Jun. 5, 2000

Related U.S. Application Data

(60) Provisional application No. 60/137,466, filed on Jun. 4, 1999.

(51) Int. Cl.[7] ..... B23P 17/00

(52) U.S. Cl. ..... 29/423; 29/419.1; 29/424; 29/599

(58) Field of Search ..... 29/419.1, 423, 29/424, 599

(56) References Cited

U.S. PATENT DOCUMENTS

| | | | | | |
|---|---|---|---|---|---|
| 3,394,213 | A | * | 7/1968 | Roberts et al. | 264/102 |
| 3,788,820 | A | | 1/1974 | Hunt | |
| 3,807,026 | A | * | 4/1974 | Takeo et al. | 29/419.1 |
| 3,864,807 | A | * | 2/1975 | Schneider et al. | 148/530 |
| 3,904,343 | A | * | 9/1975 | Scott, Jr. | 425/472 |
| 4,209,122 | A | | 6/1980 | Hunt | |
| 4,323,186 | A | | 4/1982 | Hunt | |
| 4,606,884 | A | | 8/1986 | Gavinet et al. | |
| 4,777,710 | A | | 10/1988 | Hunt | |
| 5,007,577 | A | * | 4/1991 | Nakasuji et al. | 228/265 |
| 5,088,183 | A | * | 2/1992 | Kanithi | 29/599 |
| 5,873,158 | A | * | 2/1999 | Sulten et al. | 29/599 |
| 5,890,272 | A | * | 4/1999 | Liberman et al. | 29/419.1 |
| 5,926,942 | A | * | 7/1999 | Kubo et al. | 29/599 |
| 6,038,759 | A | * | 3/2000 | Teuho | 29/599 |
| 6,199,266 | B1 | * | 3/2001 | Meserve | 29/599 |
| 6,287,487 | B1 | * | 9/2001 | Elledge et al. | 264/1.25 |
| 6,308,392 | B1 | * | 10/2001 | Mann et al. | 29/424 |
| 6,324,746 | B1 | * | 12/2001 | Bruzek et al. | 29/599 |

* cited by examiner

*Primary Examiner*—Gregory M. Vidovich
*Assistant Examiner*—Essama Omgba
(74) *Attorney, Agent, or Firm*—Frost Brown Todd LLC

(57) ABSTRACT

A method and fixture for filled billet packing wherein an entire pack is built up in a single step. Substantially even lateral forces are applied to wires and other elongated members within the billet by inserting filler rods at one or more places along the periphery of the pack.

22 Claims, 11 Drawing Sheets

| | (a) OLD ART | (b) SINGLE PACK FIXTURE | (c) SINGLE PACK FIXTURE + FILLER WIRE |
|---|---|---|---|
| AVERAGE OVALITY* (inches) | .0043 | .0032 | .0031 |
| STANDARD DEVIATION (σ) (inches) | .0026 | .0021 | .0051 |
| % OF WIRES WITHIN ±.002 inches | 40.9% | 58.9% | 72.0% |

METHOD AND FIXTURE FOR FILLED BILLET PACKING

This is a non-provisional application based upon an earlier filed provisional application, Ser. No. 60/137,466 filed Jun. 4, 1999.

FIELD OF THE INVENTION

This invention relates to wire making and specifically to a method and fixture for filled billet packing wherein an entire pack is built up in a single step and wherein substantially even lateral forces are applied to wires or other elongate members within the billet by using filler rods at one or more places along the periphery of the pack.

BACKGROUND OF THE INVENTION

The concept of using a filled billet manufacturing technique to make wires is known in the art. For example, U.S. Pat. No. 4,209,122, issued to Hunt on Jun. 24, 1980, discloses a method of making wires comprising the steps of providing a cylindrical can which has a closed end, an open end, and a central longitudinal axis; disposing a plurality of rods into the can through its open end in parallel relation to each other and parallel to the longitudinal axis; introducing a powdered filler material into the can to fill the spaces between the rods and the interior surface of the can; attaching a top to the open end of the can to thus complete a filled billet; heating the filled billet to a temperature approximately equal to the forging temperature of the rods; extruding the filled billet through an extrusion die to effect an area reduction in the cross-section thereof and of the rods therewithin; cooling the extruded filled billet; and removing the extruded can from around the extruded rods.

It is also known in the art to use a fixture that aids in the build-up of a group, or pack, of rods. The pack of rods is subsequently placed inside the extrusion can. An example of this is described in U.S. Pat. No. 4,777,710, issued to Hunt on Oct. 18, 1988. The fixture found in the '710 patent allows build-up of the pack of rods in a row-by-row manner; with rods in each subsequent row fitting between the rods in the previous row.

However, fixtures in the prior art are limited to producing only half of the required pack of rods. The two half packs must then be aligned to mate with one another to create the full pack that is ultimately positioned inside the extrusion can. As a result of extrusion, the fixture described in the '710 patent can cause the wires along the mating surfaces of the two halves to become flattened, due to difficulty in aligning the two halves, as shown in FIGS. 10–13. This results in loss of these wires as useful product or in a need to round up the wires by centerless grinding or rolling, which increases manufacturing costs, and may reduce yield on finished wire. In addition, due to the inability to seat the halves properly, the pack is not as densely built up and space is lost that otherwise would have been used to pack more rods.

A further disadvantage of the prior art fixtures, such as that described in the '710 patent, is that extrusion causes wires on the periphery of the pack to become oval shaped or irregular, as shown in FIGS. 10–13. This is because there are unequal forces surrounding the peripheral wires during extrusion. The peripheral wires are in contact with other wires from inside the pack on their inner side(s), and filler powder on their outer side(s) that is placed between the pack of wires and the inner diameter of the can. Since the filler powder starts out at 40% to 60% of theoretical density and the wires are cast at essentially 100% density, the peripheral rods experience uneven forces during extrusion, and elongate in the weaker direction, toward the powder, where there is less support. Oval wires must be centerless ground or otherwise processed to round them up, resulting in loss of material, increased labor costs, and increased turn times. In some cases, the ovality is severe enough that the wires must be scrapped.

Another problem with the wire making method described in the prior art is that close packing of circular cross-section rods results in a hexagonal shaped pack. In order to densely pack the rods, rods are packed in rows such that the rods from one row rest in interstices between two rods of a second row and the pack naturally becomes hexagonal shaped. Because the hexagonal shaped pack must fit into the circular shaped extrusion can, space is wasted in the extrusion can around the pack, and as discussed above, gaps between rods and the inner diameter of the extrusion can cause rods to become oval shaped or otherwise misshapen during extrusion.

A further problem with the wire making method described in the prior art is rod end loss. During extrusion waste may occur at the ends of the rods of the pack when the extrusion can is pushed through a substantially smaller hole in the die of the extrusion press. This is true because rods on the inside of the pack often enter the plane of the extrusion die before the rods on the outside of the pack, causing uneven extrusion and unusable material on each end of the pack after extrusion. It is desirable to shape the pack such that all rods enter the plane of the extrusion die at the same time to substantially reduce or eliminate this waste.

In view of the foregoing limitations and shortcomings of the prior art, as well as other disadvantages not specifically mentioned above, it should be apparent that there exists a need in the art for a method and fixture for filled billet packing wherein a whole pack can be made at one time, eliminating a need to mate two halves, and wherein substantially even forces are applied to all rods or other elongate members within the billet.

It is therefore a primary object of the present invention to provide a method and fixture for filled billet packing that eliminates the misshapen wires along the mating surfaces of two half packs caused by misalignment of the two halves.

Another object of the present invention is to provide a method and fixture for filled billet packing that results in higher yields, lower manufacturing costs, and shorter manufacturing turn time.

It is a further object of the present invention to reduce the ovality of peripheral wires in a wire pack, by reducing the stress differential around the peripheral rods during extrusion.

It is another object of the present invention to create a rounder pack shape that conforms more closely to the inner diameter of the can, resulting in more uniform, hydrostatic forces on all rods.

It is a further object of the present invention to provide a means for shaping a pack of wires that reduces or eliminates waste of the ends of the rods of the pack after extrusion.

SUMMARY OF THE INVENTION

Briefly described, these and other objects are accomplished according to the present invention by providing a method and fixture for filled billet packing wherein rods are placed within a fixture having a substantially symmetrical area for accepting rods therethrough that can accommodate an entire pack of rods, and clamping means that apply lateral force to the pack to densely pack the rods. The fixture contains a shaping tool for creating a pack that is substantially cylindrical in shape which results in a pack whose cross-section more closely approximates the cylindrical inner diameter of an extrusion can, resulting in a more densely packed billet. The shaping tool also reduces or eliminates waste at the ends of the rods of the pack after extrusion. Dummy rods may be placed at one more places along the periphery of the pack within the fixture to help maintain tight packing. Filler rods are placed around the periphery of the pack in the extrusion can to apply lateral force to the peripheral rods that is substantially equal to the lateral forces imposed by rods inside the pack.

Additional benefits and advantages of the present invention will become apparent to one skilled in the art to which the present invention relates from the subsequent description of the preferred embodiment and the appended claims, taken in conjunction with the accompanying drawings.

DESCRIPTION OF THE PREFERRED EMBODIMENT

Figure 1:
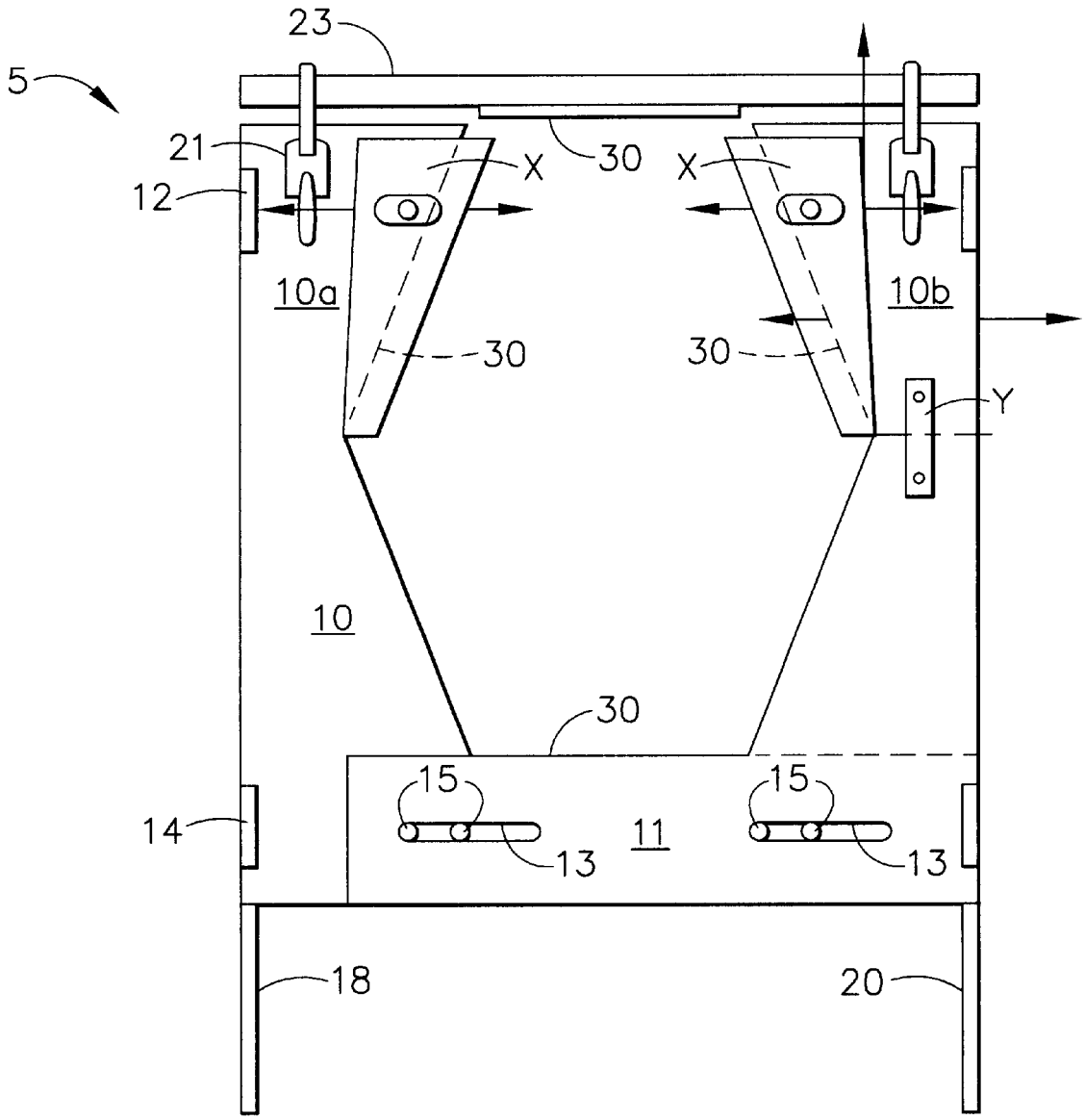
FIG. 1 is a front elevational view of the fixture of the present invention showing the upper clamping system in a disengaged position.
Figure 2:
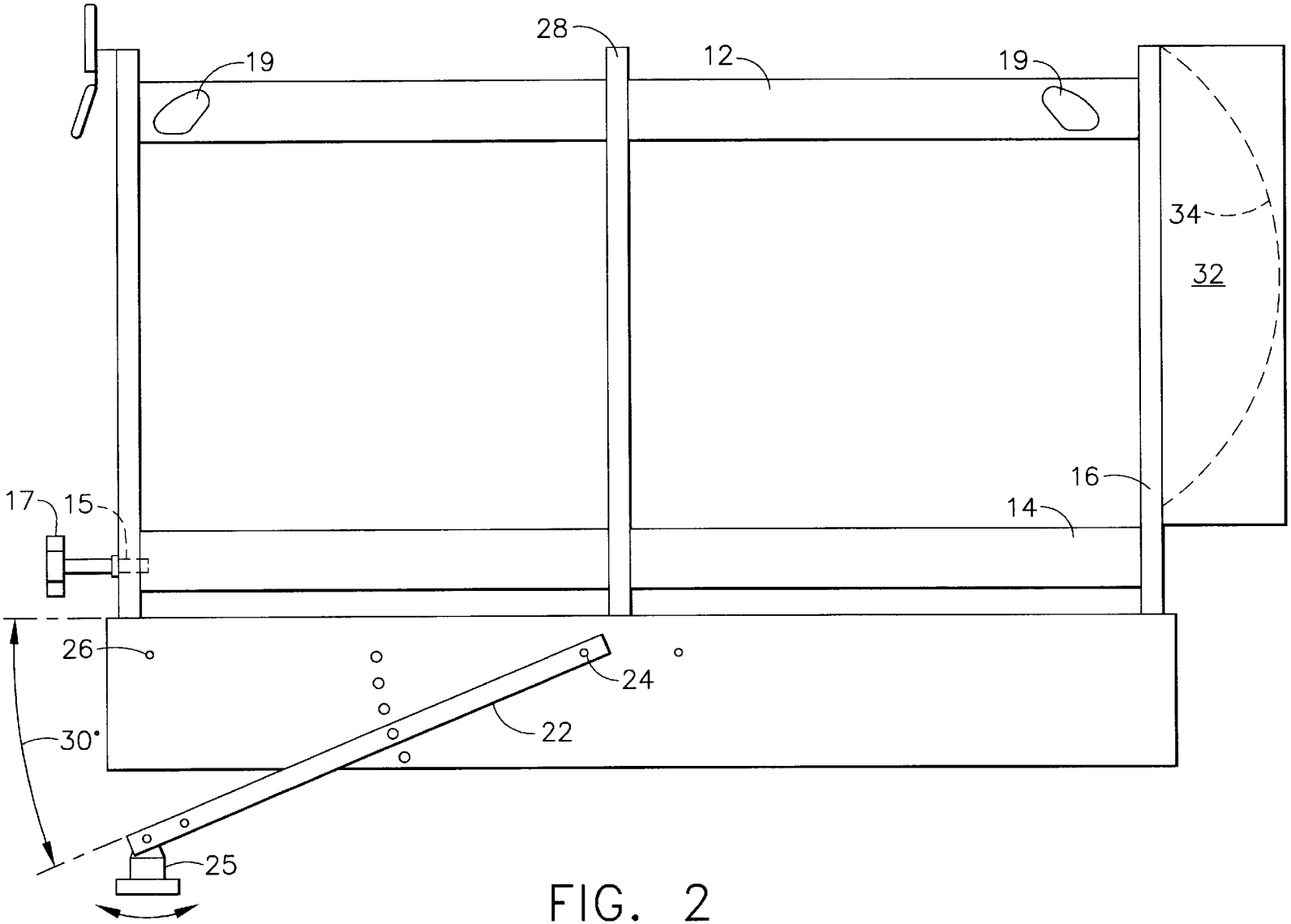
FIG. 2 is a side elevational view of the fixture in accordance with the present invention showing the locking device in an unlocked position.

Referring now in detail to the drawings, there is shown in FIGS. 1 and 2 the fixture 5 of the present invention. Fixture 5 is comprised of a front face 10, a middle face 28, a back face 16, which are connected by side plates 12 and 14 to form a substantially rectangular shaped fixture 5. Side plates 12 and 14 are attached to front face 10, middle face 28, and back face 16 by suitable means to allow fixture 5 to provide support to rods or other elongate members (not shown) placed within fixture 5. Preferably side plates 12 and 14 are attached by means including welding or other mechanical means. Side plates 12 and 14 may also contain lifting lugs 19 which aid in lifting fixture 5.

Figure 3:
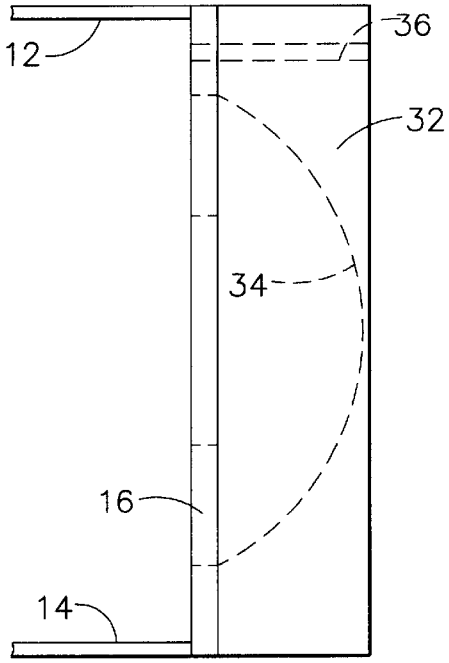
FIG. 3 is a top view of the back face and shaping tool of the fixture of the present invention.
Figure 4:
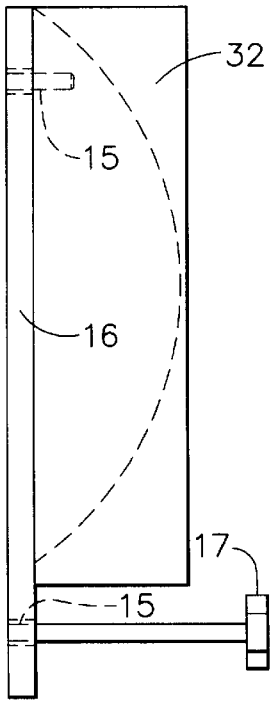
FIG. 4 is a side elevational view of the back face and shaping tool of the present invention.

A shaping tool 32 is attached to back face 16. (FIGS. 2, 3 and 4). Shaping tool 32 shapes a pack of rods to reduce or eliminate extrusion waste. During extrusion, waste may easily occur on the ends of the pack when the extrusion can is pushed through a substantially smaller hole in the die of the extrusion press. Typically a 6 inch outer diameter extrusion can is pushed through a die containing a 1½ inch diameter hole. Typically the extrusion can is first pushed through a tapered transition zone and into the plane of the extrusion die. As the rods are pushed through the tapered transition zone, rods on the outside of the pack hit the surface of the tapered zone first and are slowed down compared to the rods on the inside of the pack, which then enter the plane of the extrusion die before the rods on the outside of the pack. This can cause uneven extrusion and wasted material on each end of the pack after extrusion. It is desirable to shape the pack such that all rods enter the plane of the extrusion die at the same time.

As shown in FIG. 3, shaping tool contains dugout 34. Dugout 34 creates a pack of rods having a convex back end and a concave front end. When rods are inserted into fixture 5, they make contact with shaping tool 32. The shape of dugout 34 determines how far the rods are inserted into fixture 5. The rods forming the pack fit within dugout 34. Preferably, dugout 34 is substantially circular in shape and of similar diameter to the inner diameter of an extrusion can.

Figure 5:
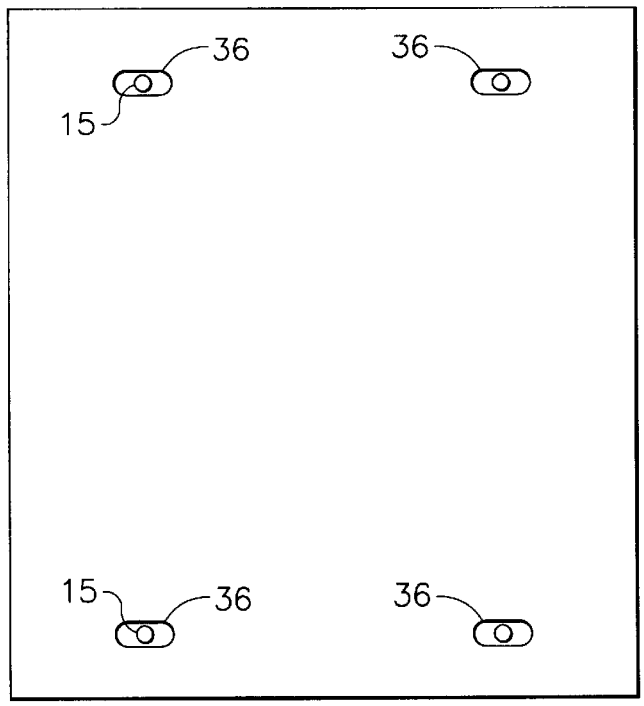
FIG. 5 is an end view of the fixture of the present invention showing the back of the shaping tool.

Shaping tool 32 has tapped holes 36 through which suitable fasteners 15 attach it to back face 16 (FIGS. 4 and 5). Suitable fasteners 35 include dowel pins and knobs, or other mechanical means such as bolts. As shown in FIGS. 2 and 4, a knob 17 may be fit over each end of fastener 15, which is rotated to clamp fixture 5. Knob 17 tightens upon rotation in a first direction and loosens upon rotation in a second direction. Shaping tool 32 may slide laterally within tapped holes 36 when fixture 5 is tightened and loosened upon rotation of knob 17. The shaping tool could also be designed to slide up and down or in other directions.

As shown in FIG. 1, front face 10 has inner surfaces 30 which act to support rods placed within fixture 5. Middle face 28 and back face 16 have similar inner surfaces 30 (not shown). Inner surfaces 30 form an area through which rods or other elongate members are inserted to form a pack (not shown). Rods are inserted within fixture 5 through front face 10, middle face 28, and back face 16 until they make contact with shaping tool 32 (FIG. 2). Rods are placed within fixture 5 to form a pack that fills the area formed by inner surfaces 30 such that peripheral rods on the pack make contact with inner surfaces 30 (FIG. 1). In this manner, inner surfaces 30 support rods placed within fixture 5. Fixture 5 may contain one or more middle faces 28 depending on the length, weight and/or stiffness of the rods in the pack.

Preferably front face 10 is further comprised of two pieces 10*a* and 10*b*, as shown in FIG. 1. A faceplate 11 may be attached to piece 10*a* or 10*b*. Alternatively, piece 10*a* or piece 10*b* may be formed substantially "L" shaped. Faceplate 11 connects pieces 10*a* and 10*b* together and provides an inner surface 30 to support rods placed within fixture 5. Faceplate 11 may be attached to piece 10*a* and/or 10*b* by suitable fasteners 15 such as bolts. Faceplate 11 has slots 13 through which suitable fasteners 15 attach pieces 10*a* and/or 10*b* together. Slots 13 allow front face 10 to be laterally adjusted to build different sized packs. Middle face 28 and back face 16 contain similar faceplates allowing their sizes to be similarly adjusted (not shown).

Adjustable face plates or slides X, may be attached to pieces 10*a* and 10*b* to provide additional lateral force to the top portion of the pack. Middle face 28 and back face 16 may contain similar slides X.

Front face 10, middle face 28 and back face 16 may contain hinges Y on one or both sides to allow for easy removal of the completed pack.

The area formed by inner surfaces 30 is of sufficient shape and size to form the entire of pack of wires at one time. Thus, the method revealed in the prior art of forming two half packs of rods which are mated to form a single pack of rods of the correct size and shape for the billet, is eliminated. This prevents rods on the edges of the mating surfaces from becoming flattened or misshapen due to misalignment of the two halves.

The area formed by inner surfaces 30, front face 10, middle face 28, and back face 16 may be any substantially symmetrical shape including a circle, hexagon, octagon, or other polygon. As the shape of the area more closely resembles that of the inner diameter of an extrusion can, less space within the extrusion can is wasted. It is preferred to use an area that conforms to the cylindrical shape of the inner diameter of an extrusion can, but that has multiple sides such that when rods are placed within fixture 5, they will lie flat in rows in parallel relation to each other to maximize the number of rods fitting within the area and prevent rods from deforming irregularly during extrusion. Using a shape that more closely conforms to the cylindrical inner diameter of an extrusion can is advantageous over the fixtures found in the prior art, which formed two trapezoidal shaped packs that had to be mated to form a shape that more closely resembled that of the inner diameter of an extrusion can.

The area is preferably sized to have a diameter that is substantially similar to the inner diameter of an extrusion can. The size of the extrusion can is limited by the capabilities of the particular extrusion press employed. Broadly the diameter may typically be from 1 inch to 46 inches, and is preferably 6 to 14 inches. Preferably the area formed by inner surfaces 30 is shaped to allow the pack of rods to easily be placed substantially symmetrically within a substantially cylindrical extrusion can.

Figure 8:
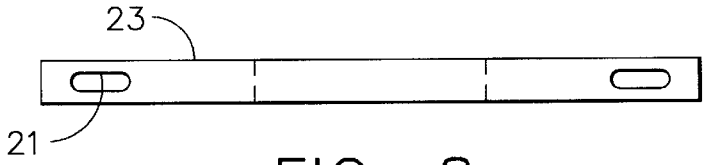
FIG. 8 is a top view of the clamping plate of the present invention.

Fixture 5 contains clamping means to apply lateral forces to rods or other elongate members placed within fixture 5 to tightly and densely pack the rods. Preferably the clamping means provides sufficient forces to densely pack the rods, but without crushing or otherwise damaging any protective coating applied to the rods. Protective coatings, such as a ceramic slurry, may be applied to the rods to facilitate separating the rods after extrusion, as described in detail in the prior art. Any clamping means known in the art may be used. Clamping means preferably include an upper clamping system and a lower clamping system. Preferably, a clamp 23 is attached onto front face 10 by clamping hitches 21 (FIGS. 1 and 8). Similarly, clamps 23 are attached onto middle face 28 and back face 16 by clamping hitches 21 (not shown). Clamps 23 may also be fastened by suitable means to side plates 12 and 14 independent of faces 10, 28, and 16. The number of clamps 23 required depends on the length of the rods of the pack.

Preferably, fixture 5 also contains two side frame members 18 and 20 upon which fixture 5 stands (FIG. 1). Side frame members 18 and 20 house tilt bars 22, which are shown in an unlocked position in FIG. 2. Tilt bars 22 pivot at shoulder bolt 24 and pivot downward from a locked position 26 to tilt the fixture into a position conducive to subsequent processing, particularly welding of the end of the pack. A pad device 25 may be pivotally attached to the end of tilt bars 22 to provide a stable interface between the fixture 5 and the work surface.

Fixture 5 may be made from any material suitable to carry the load of a fully assembled pack. Preferably fixture 5 is constructed of steel.

Figure 6:
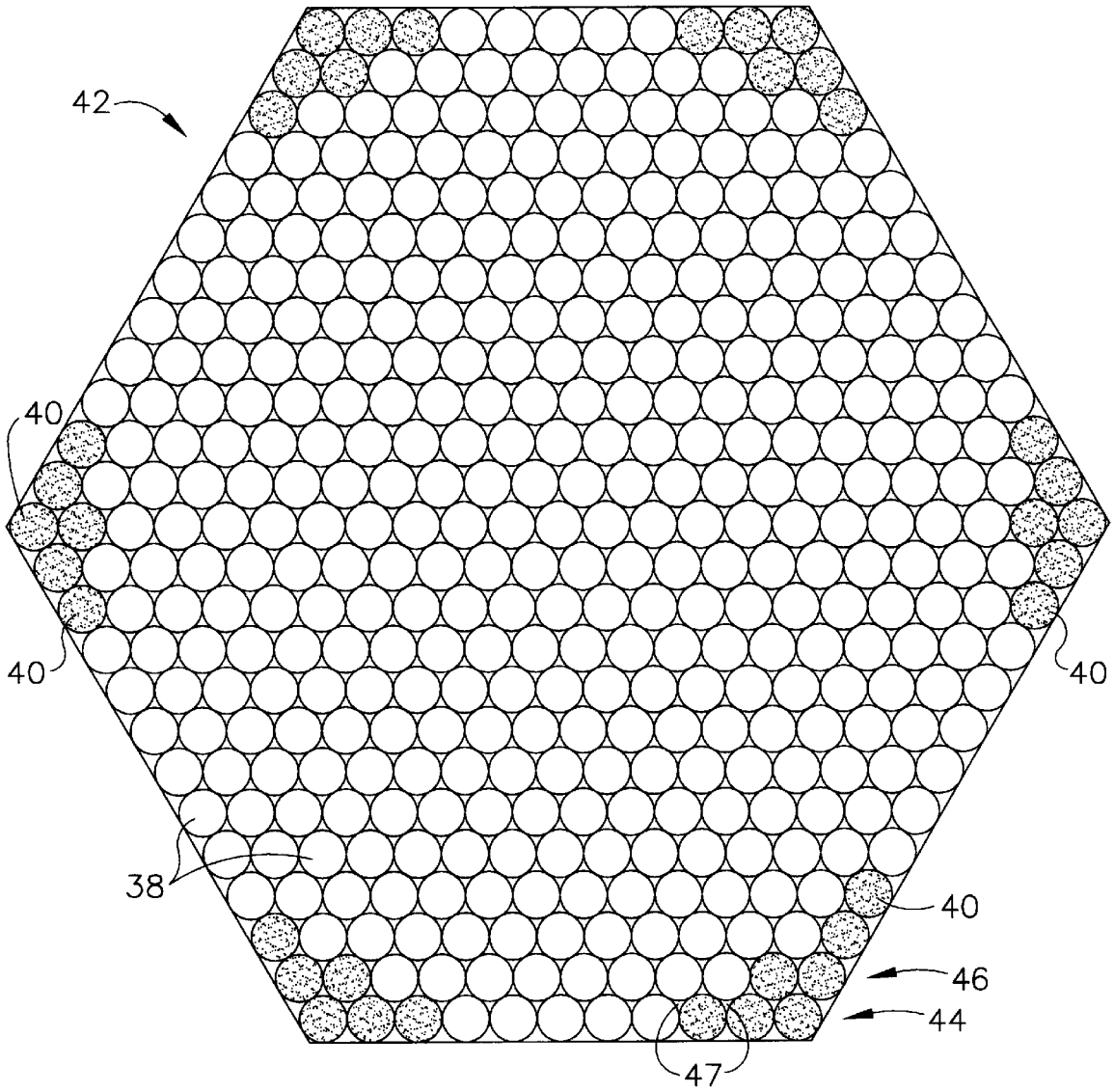
FIG. 6 is a cross sectional view showing a pack of rods and dummy rods in the fixture of the present invention.

In the method of the present invention, rods 38 are placed within fixture 5 in a row-by-row manner. (FIG. 6). Rods may be made from iron-, cobalt-, nickel-based alloys, or other alloys, as described in detail in the prior art. Preferably rods 38 are coated with a substance, such as ceramic slurry, which will allow rods 38 to easily be separated after extrusion. Rods 38 are placed in fixture 5 through the area formed by inner surfaces 30 of front face 10, upper plate 12 and lower plate 14. Rods 38 slide within fixture 5 passing through middle face 28 and back face 16 to make contact with shaping tool 32.

The first row 44 of rods 38 rests upon inner surfaces 30 of front face 10, middle face 28, and back face 16. Rods 38 of varying sizes may be used. The number of rods that fit into the first row depends upon the diameter of the rods and the inner diameter of the can. For example, if ¼ inch diameter rods 38 are used with an extrusion can having a 5¼ inch inner diameter, twelve rods 38 will fit into first row 44; if 3/16 inch diameter rods 38 are used, seventeen rods 38 will fit into first row 44; and if 5/32 inch diameter rods 38 are used, nineteen rods 38 will fit into first row 44.

A second row 46 of rods 38 is placed into fixture 5 such that rods 38 of second row 46 rest upon rods 38 of first row 44. Preferably, rods 38 of second row 46 rest in interstices 47 formed between adjacent pairs of rods 38 in first row 44. This densely packs fixture 5 and helps prevent rods 38 from becoming misshapen during extrusion due to uneven lateral forces applied during extrusion. Uneven lateral forces can result where rods 38 of two adjacent rows are lined up because adjacent rods 38 apply a greater lateral force than filler powder which is placed in gaps between rods 38. Lining up adjacent rows of rods 38 (i.e., not placing them in the interstices) results in larger gaps.

Each subsequent row is built in this manner until the area formed by inner surfaces 30 is filled and a pack 42 is formed. Rods 38 of each row fit in interstices 47 between adjacent pairs of rods 38 in the adjoining above and below rows. In this manner, rods 38 are densely packed together, which prevents rods 38 from deforming irregularly during extrusion due to uneven lateral forces caused by gaps between rods 38. When densely packed, rods 38 form a substantially hexagonal shaped pack 42.

Preferably, each row contains one more rod 38 than the previous row until the center row, after which each row contains one less rod 38 than the preceding row. The number of rows that fit within fixture 5 depends in part upon the size of rods 38 used and the inner diameter of the extrusion can. For example, if ¼ inch rods 38 are used with an extrusion can having a 5¼ inch inner diameter, twenty-three rows will fit within fixture 5; if 3/16 inch rods 38 are used, thirty-two rows will fit within fixture 5; and if 5/32 inch rods 38 are used, thirty-seven rows will fit within fixture 5.

Rods 38 may be of different alloys, although the co-extrusion process works best if their flow stresses are similar at the extrusion temperature. Preferably rods 38 forming a pack 42 are of the same alloy. Preferably after each row is built within fixture 5, loose material from coating rods 38 is removed by brushing, blowing with compressed air, or other suitable means.

Dummy rods 40 may be placed in one or more places along the periphery of pack 42. Dummy rods 40 aid in forming pack 42 to more closely resemble the substantially cylindrical shape of the inner diameter of the extrusion can.

Preferably, dummy rods 40 are placed in the corners of the substantially hexagonal shaped area formed by inner surfaces 30, such that the rods 38 form a substantially cylindrical pack 42. In this manner, pack 42 is shaped to fit within the inner diameter of an extrusion can to facilitate placing pack 42 in the extrusion can and to prevent rods 38 from deforming irregularly during extrusion due to uneven lateral forces caused by gaps between peripheral rods 38 and the inner diameter of an extrusion can. Dummy rods 40 may be made of different metal alloys or non-metals. Preferably, dummy rods 40 are made of plain carbon steel or stainless steel.

Figure 9:
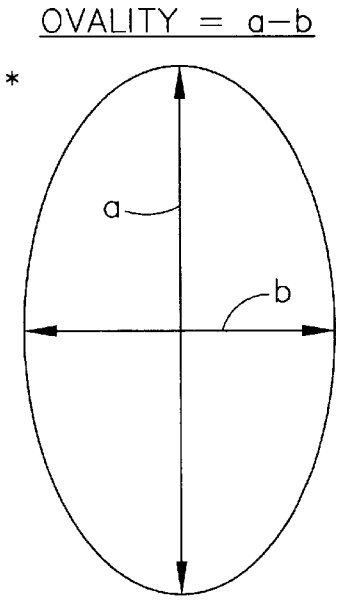
FIG. 9 is a table comparing the average ovality of wires in a pack created by the method described in the prior art and created by the method of the present invention.
Figure 10:
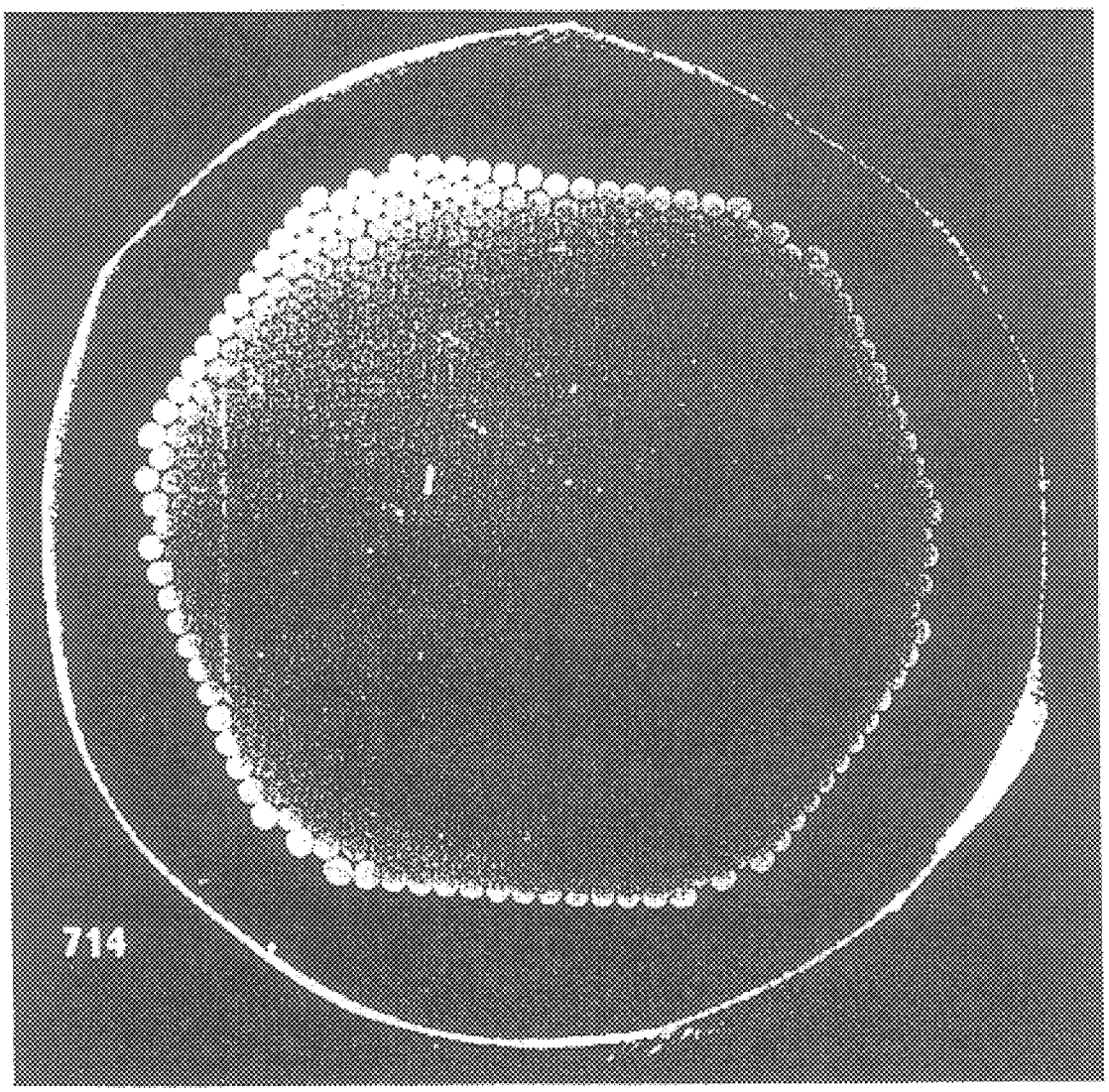
FIGS. 10–13 are cross-sectional views of an extruded pack of wires created by the method described in the prior art which reveal misshapen wires along the mating surfaces of the two half packs.
Figure 11:
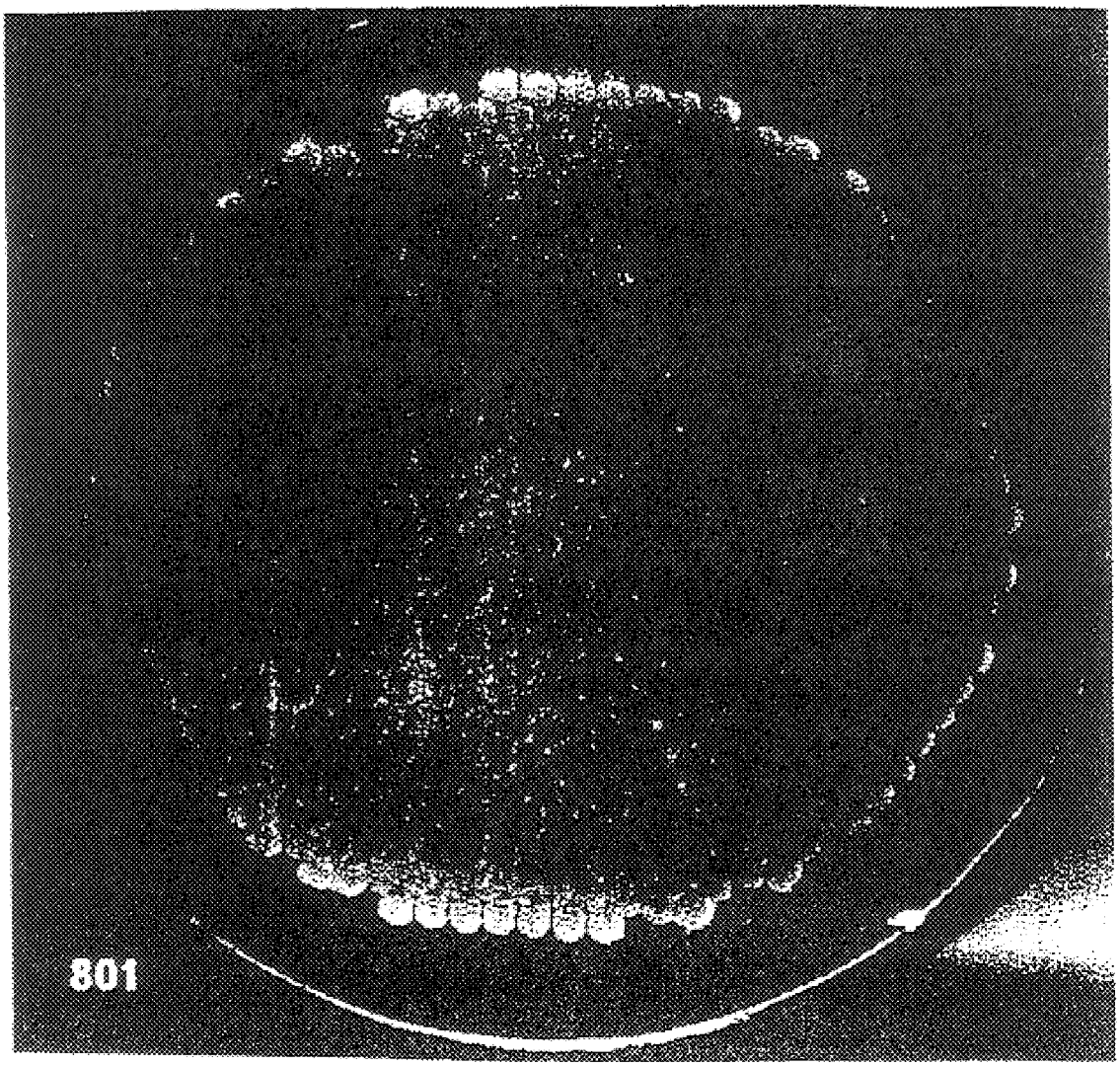
Figure 12:
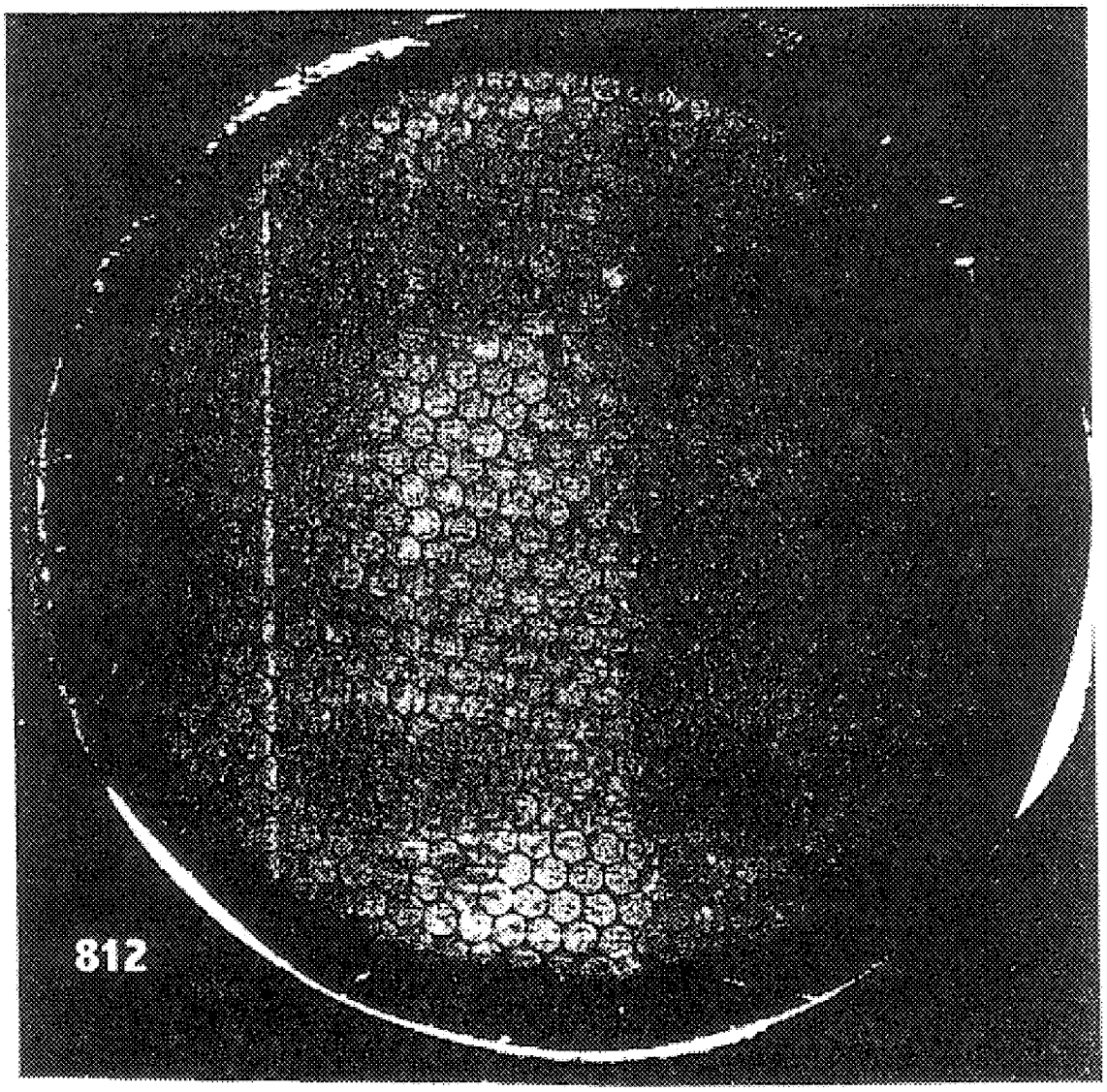
Figure 13:
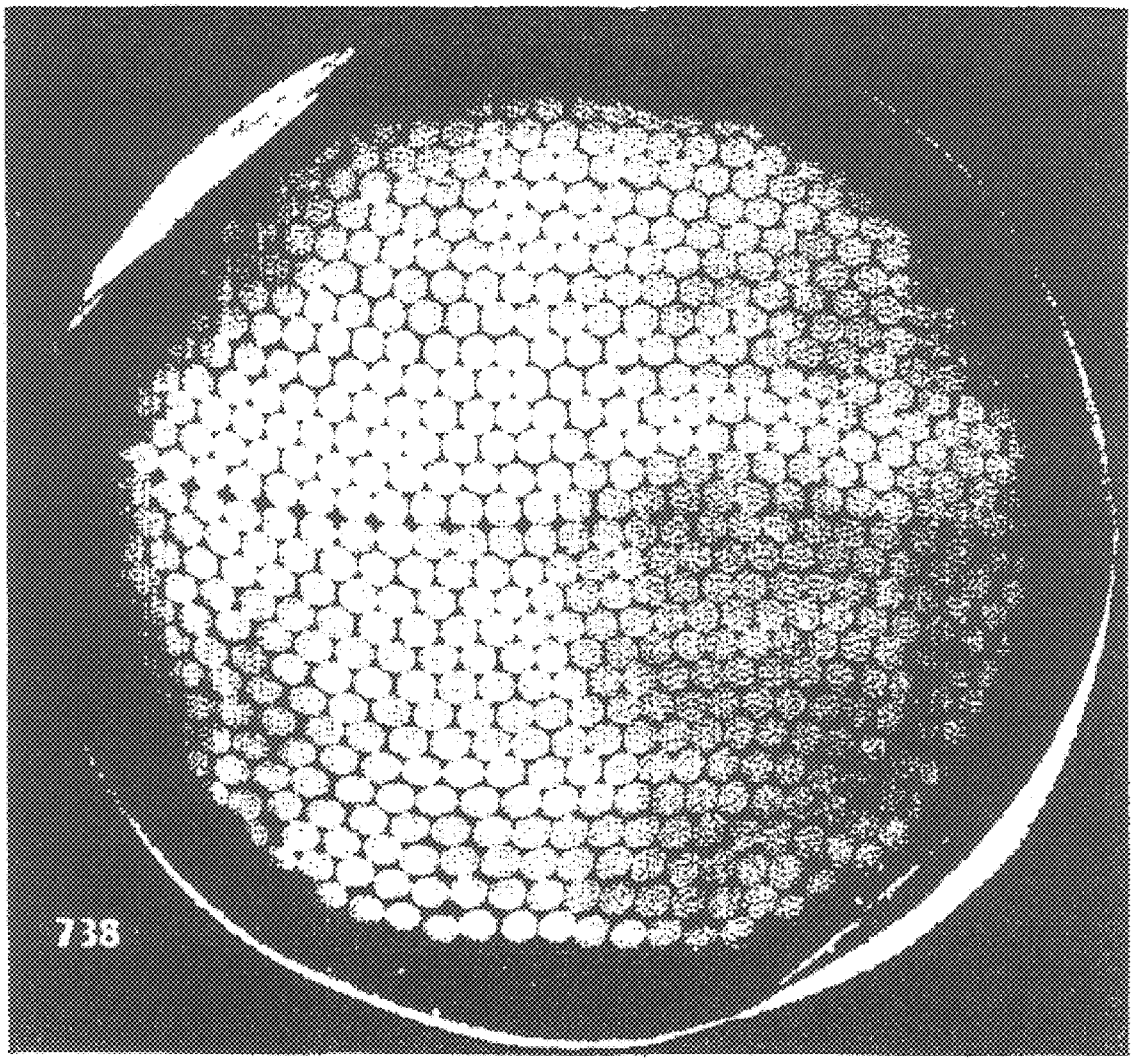
Figure 14:
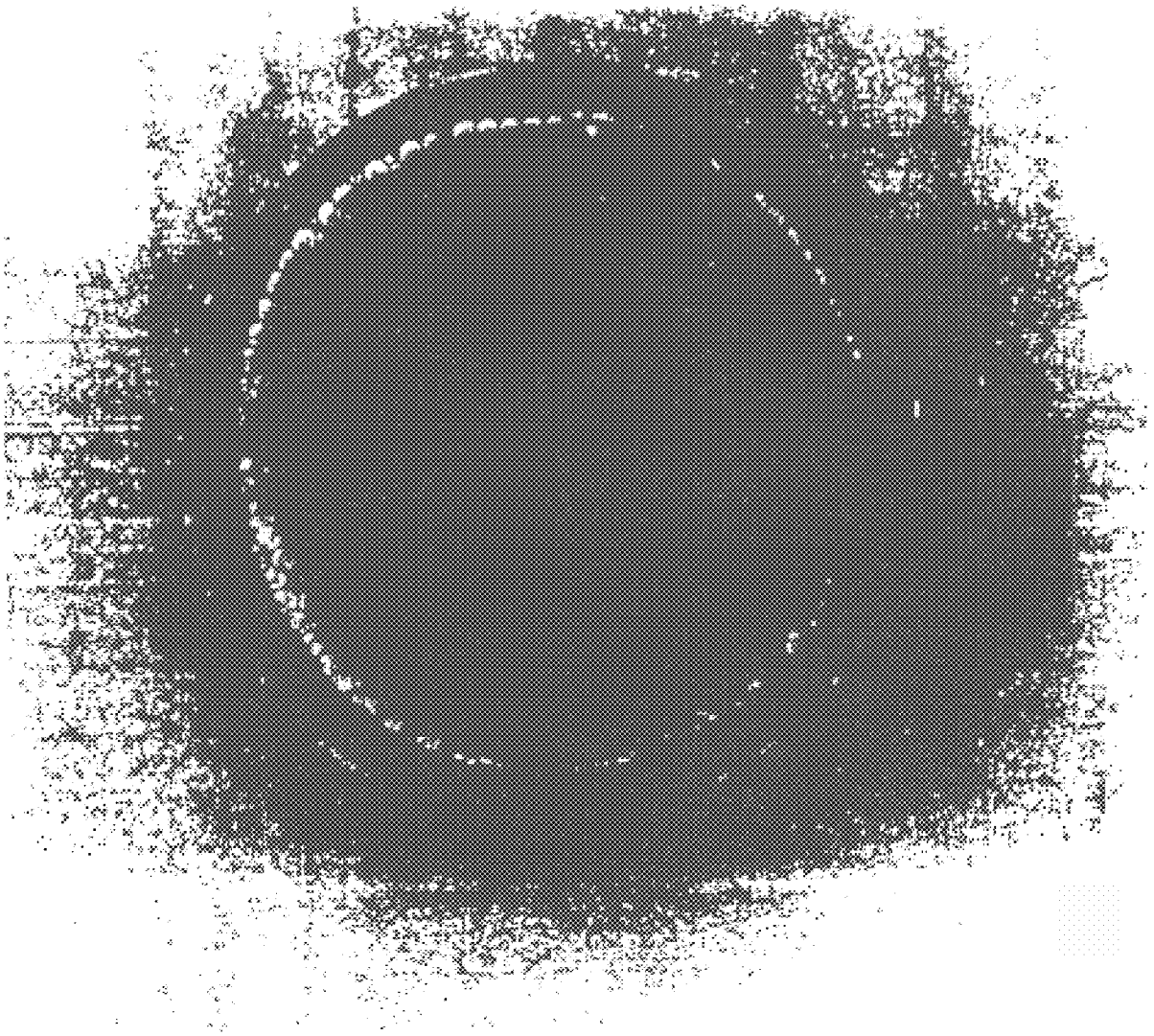
FIG. 14 is a cross-sectional view of an extruded pack of wires of the present invention.

When rods 38 make contact with shaping tool 32, rods 38 that do not fit within dugout 34 may be removed and replaced by dummy rods 40. A user may readily tell whether a rod 38 fits within dugout 34 because rods 38 not fitting within dugout 34 will not slide into fixture 5 as far as rods 38 fitting within dugout 34; they will stick out of fixture 5. Because the circumference of dugout 34 is substantially circular, any pack 42 that is built using dugout 34 will be substantially cylindrical. In this manner, dugout 34 aids in building pack 42 to more closely resemble the inner diameter of the substantially cylindrical extrusion can. FIG. 9 shows that the average roundness of the wires in pack 42 improves significantly when the circumference of pack 42 more closely resembles the inner diameter of an extrusion can.

It is also important to keep rods 38 straight when placing them within fixture 5. If rods 38 in a first row are even slightly crooked, rods 38 in subsequent rows, which lay upon the adjacent row, also become crooked in fixture 5. This problem compounds as more rows are placed within fixture 5, which results in fewer rods 38 fitting within fixture 5 and causes rods 38 to become irregularly deformed during extrusion.

After pack 42 is built, it is clamped. Preferably clamping provides sufficient lateral force to densely compress pack 42, but without crushing or otherwise damaging the ceramic coating on rods 38. Pack 42 is squeezed together to minimize gaps between rods 38. Preferably the clamping pressure is between 1 and 40 foot-pounds.

While pack 42 is clamped, the ends of rods 38 are affixed together to allow fixture 5 to be removed without disassembling or decompressing pack 42. Pack 42 is affixed such that rods 38 remain squeezed together after fixture 5 is removed. Preferably, the ends of some or all of rods 38 are welded together. Appropriate welding techniques and materials are well known in the art and may include gas tungsten arc or gas metal arc processes using stainless steel or other appropriate filler wire. Preferably, shaping tool 32 is removed and the back ends of some or all rods 38 are welded together. Preferably, on the front ends of rods 38, only the peripheral rods 38 are welded together and interstices 47 between rods 38 are not filled with welding material. It is preferable to keep interstices 47 unfilled so that filler powder can be introduced into interstices 47 to fill any gaps between rods 38 to prevent rods 38 from becoming irregularly deformed during extrusion. Dummy rods 40 are not welded to pack 42. Alternately, a plate whose geometry conforms to that of the end of the pack may be welded to the end of the pack.

Preferably, any loose material is blown away with an air hose after welding. Handling rods (not shown) may be welded to the front end and back end of pack 42 to aid in maneuvering pack 42 into an extrusion can and positioning pack 42 within an extrusion can. Handling rods are preferably one-inch long steel bolts but may be made of other alloys and/or lengths.

Next, pack 42 is removed from fixture 5 and dummy rods 40 are discarded. Pack 42 remains compressed and gaps between rods 38 remain minimal because rods 38 were affixed while the lateral clamping forces squeezed the rods 38 together.

Figure 7:
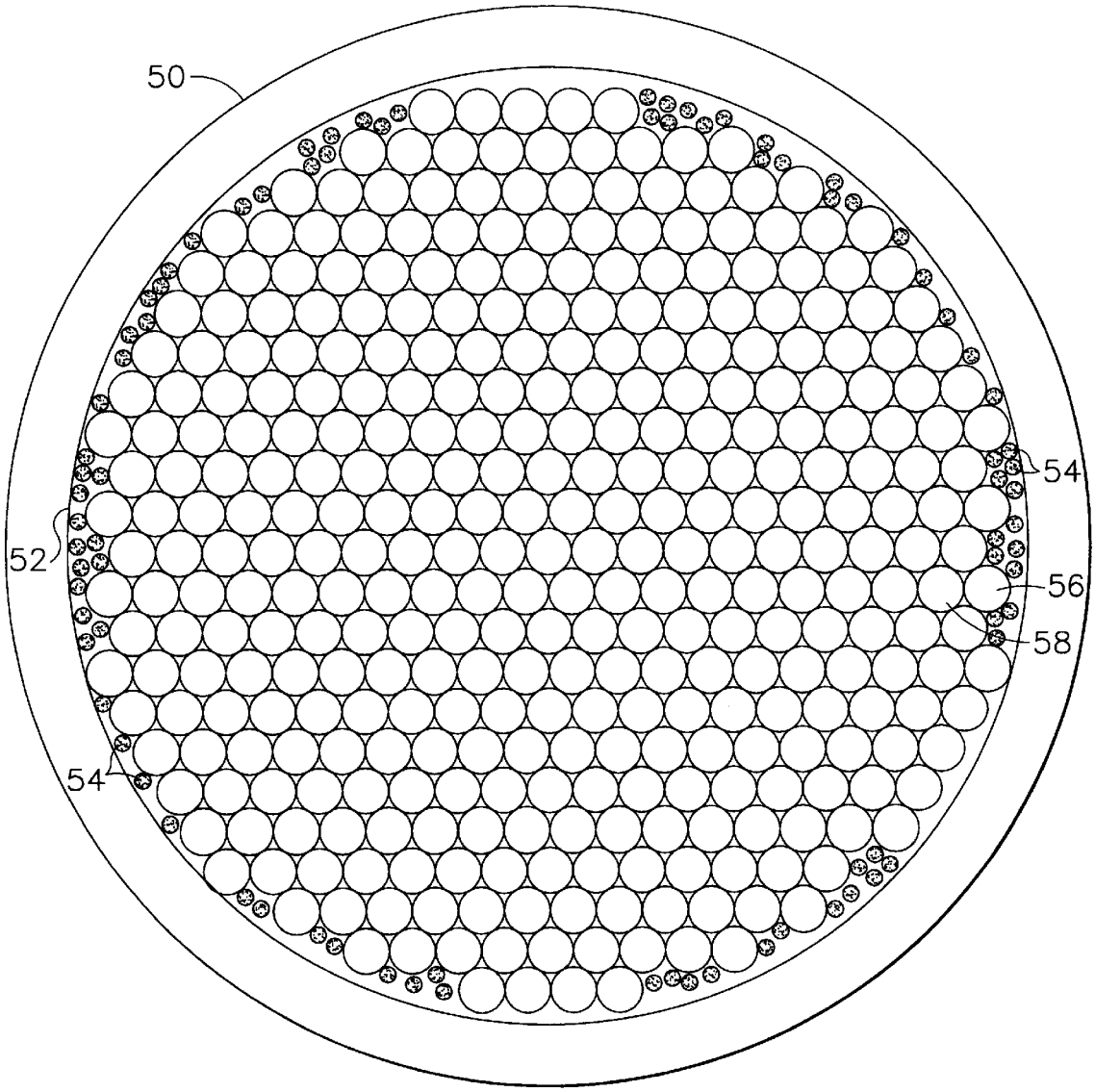
FIG. 7 is a cross sectional view of a pack of rods and filler rods in a billet in accordance with the present invention.

As shown in FIG. 7, pack 42 is placed within an extrusion can 50. Extrusion can 50 has an end (not shown), an inner wall 52, and is of sufficient length to accept pack 42 therein. Extrusion can 50 may be of any size and shape, and is limited by the capabilities of the extrusion press. Preferably extrusion can 50 is between 28 and 30 inches long with an outer diameter of 6 inches and an inner diameter of 5¼ inches. Prior to placing pack 42 in extrusion can 50, it is preferable to place filler material in the bottom of extrusion can 50. Filler material may be solid, powder, liquid, or a combination thereof and may be made of any material suitable for extrusion. Preferably the inner wall 52 of extrusion can 50 is coated with a substance such as ceramic slurry, to allow can 50 to be easily separated from pack 42 after extrusion.

After the pack 42 is placed inside extrusion can 50, filler rods 54 are placed in extrusion can 50 at one or more places along the perimeter of pack 42. Filler rods 54 fill gaps between pack 42 and inner wall 52 of extrusion can 50. In this manner, more even lateral forces are applied to peripheral rods 56 in pack 42, because compared to filler powder, filler rods 54 apply lateral forces to peripheral rods 56 that are more closely matched to lateral forces applied to peripheral rods 56 by inner rods 58. This reduces the number and severity of irregularly deformed wires (after extrusion) around the periphery of the pack and improves the overall roundness of the extruded wires, as shown in FIG. 9. Filler rods 54 may be made of any suitable extrudable material, and are preferably made of a steel alloy. Preferably the diameter of filler rods 54 is smaller than the diameter of rods 56 and 58 to better fill gaps and differentiate rods 38 from filler rods 54. Even more preferably, the diameter of filler rods 54 is not greater than 60% of the diameter of rods 56 and 58. If handling rods are used, they may be removed after pack 42 is placed within extrusion can 50. Filler rods may have a shaped cross-section that conform to the shape of the space that they are intended to fill.

Filler material is placed within extrusion can 50 to fill gaps between inner rods 58, gaps between peripheral rods 56 and inner rods 58, and gaps between peripheral rods 56 and inner diameter 52. By filling gaps between rods 58, filler powder helps to prevent rods 58 from losing their circular cross-section during extrusion due to uneven lateral force applied around their circumference. Filler material may be solid, powder, liquid, or a combination thereof and may be made of any material suitable for extrusion.

If a filler powder is used, it is preferably comprised of particles whose shape and size distribution aid in filling small gaps. Particle shape may be flaky, irregular, spherical, or a combination thereof. For example, a chromium or other heavy metal powder with substantially round particles may be used. If filler powder is used, preferably extrusion can 50 is shaken to allow filler powder to settle down through the billet along the lengths of rods 56 and 58. More filler powder is added as extrusion can 50 is shaken until the powder is present throughout the billet.

If a liquid filler material is used, a low-pressure vacuum system may be employed to move the liquid filler material throughout the billet. If a solid filler material is used, it may be placed in the billet during build-up of pack 42, after welding of the ends of pack 42, or any time throughout processing of the billet, prior to closing the end of extrusion can 50. If no filler material is used, the substantially cylindrical rods 38 will become substantially hexagonal in shape after extrusion. Hence, if substantially hexagonal-shaped rods 38 are desired, filler material should not be employed.

The filler material used to fill gaps between the rods 38 may be of the same material as the filler material used to fill the bottom and the top of the extrusion can 50, or may be of a different material. After filling, a cover (not shown) is affixed to the end of extrusion can 50 to close the billet, and the billet is now ready for extrusion.

We claim:

1. A method for filled billet packing comprising the steps of:

placing rods within a fixture having a longitudinal axis and inner surfaces defining a substantially symmetric geometric area for accepting said rods therein, wherein said rods are placed in parallel relation to each other and in parallel relation to said longitudinal axis to form a pack, and wherein said fixture is further comprised of a shaping tool having a dugout for defining the shape of said pack;

placing said rods into said fixture to make contact with said dugout; and clamping said fixture to apply a force lateral to said longitudinal axis to said pack to compress said pack prior to extrusion.

2. The method of claim 1 further comprising the step of affixing said rods together to allow said pack to be removed from said fixture while maintaining said pack in a compressed position, wherein a first end of said rods is affixed together; and a second end of said rods located on the periphery of said pack is affixed together.

3. The method of claim 2 wherein said rods are welded together.

4. The method of claim 1 further comprising the steps of removing said pack from said fixture; and placing said pack within an extrusion can having an end, an inner wall, and a length sufficient to maintain said pack therein.

5. The method of claim 4 further comprising the step of placing filler rods in said extrusion can around said pack to fill gaps between said pack and said inner wall.

6. The method of claim 5 wherein said filler rods are substantially cylindrical in shape.

7. The method of claim 5 wherein said filler rods are of a smaller diameter than said rods.

8. The method of claim 5 wherein said filler rods are made of the same material as said rods.

9. The method of claim 5 further comprising the step of placing filler material within said extrusion can to fill gaps between said rods, said filler rods, and said inner diameter.

10. The method of claim 9 wherein said filler material is further comprised of filler powder.

11. The method of claim 10 further comprising the step of shaking said extrusion can to allow said filler powder to move through said extrusion can to fill said gaps and densely pack said extrusion can.

12. The method of claim 1 wherein said inner surfaces of said fixture form a substantially hexagonal shaped area.

13. The method of claim 1 wherein said rods are placed within said fixture in a row by row manner, and wherein said rods of a first row lay upon said rods of a second row in interstices between said rods in said second row.

14. The method of claim 1 wherein dummy rods are placed in one or more places along the periphery of said pack within said fixture to aid in the build up of said pack.

15. The method of claim 14 wherein said pack is built substantially cylindrical in shape.

16. The method of claim 1 wherein said fixture is further comprised of a front face, a back face, and clamping means for applying lateral compressive force to said pack; and wherein inner surfaces upon said front face and said back face define a substantially symmetrical geometric area for accepting wires therein.

17. The method of claim 1 wherein said fixture is further comprised of a middle face; and wherein inner surfaces upon said middle face define a substantially symmetrical geometric area for accepting wires therein.

18. A method for filled billet packing comprising the steps of:

placing rods within a fixture having a longitudinal axis and inner surfaces defining a substantially symmetric geometric area for accepting said rods therein, wherein said rods are placed in parallel relation to each other and in parallel relation to said longitudinal axis to form a pack, and wherein said fixture is further comprised of a shaping tool having a dugout for defining the shape of said pack;

placing said rods into said fixture to make contact with said dugout;

replacing said rods with dummy rods where said rods do not make contact with said dugout; and clamping said fixture to apply a lateral force to said pack to compress said pack.

19. A fixture for filled billet packing comprising:

a front face, a middle face, a back face, and clamping means for applying a lateral compressive force to said rods; and wherein inner surfaces upon said front face, said middle face, and said back face, form a substantially symmetrical geometric area for accepting wires therethrough; and a shaping tool having a dugout, said dugout defining an area where said rods are placed within said fixture to form a pack.

20. The fixture of claim 19 wherein said dugout is substantially circular in shape.

21. The fixture of claim 19 wherein said dugout forms a pack having a substantially convex end and a substantially concave end.

22. A method of filled billet packing comprising the steps of:

placing rods within a fixture to form a pack, wherein said fixture has a front face, a middle face, a back face, clamping means for applying a lateral compressive force to said rods, and a shaping tool having a dugout; and wherein inner surfaces upon said front face, said middle face, and said back face form a substantially hexagonal area for accepting rods therethrough;

placing dummy rods within said fixture in one or more places along the periphery of said pack to aid in the build up of said pack, wherein said pack is built substantially cylindrical in shape; and clamping said fixture to apply lateral force to said pack to compress said pack.

* * * * *